United States Patent [19]

Lynn et al.

[11] 3,978,297

[45] Aug. 31, 1976

[54] KEYBOARD SWITCH ASSEMBLY WITH IMPROVED PUSHBUTTON AND ASSOCIATED DOUBLE SNAP ACTING ACTUATOR/CONTACTOR STRUCTURE

[75] Inventors: William J. Lynn, Groveland; Richard E. Seeger, Jr., Topsfield, both of Mass.

[73] Assignee: Chomerics, Inc., Woburn, Mass.

[22] Filed: Mar. 31, 1975

[21] Appl. No.: 563,707

[52] U.S. Cl. ..... 200/5 A; 200/67 R; 200/86 R; 200/159 B; 200/302; 200/340

[51] Int. Cl.[2] ..... H01H 13/06; H01H 3/12; H01H 5/04

[58] Field of Search ..... 200/1 R, 5 R, 5 A, 16 A, 200/86 R, 159 B, 264, 292, 294, 302, 340, 67 R, 67 D

[56] References Cited

UNITED STATES PATENTS

| | | | |
|---|---|---|---|
| 3,290,439 | 12/1966 | Willcox et al. | 200/5 A X |
| 3,382,338 | 5/1968 | Arseneault et al. | 200/159 B |
| 3,584,162 | 6/1971 | Krakinowski | 200/86 R X |
| 3,591,749 | 7/1971 | Comstock | 200/159 B X |
| 3,749,859 | 7/1973 | Webb et al. | 200/159 B X |
| 3,826,882 | 7/1974 | Giolitti et al. | 200/5 A |
| 3,846,596 | 11/1974 | Wolf | 200/294 X |
| 3,860,771 | 1/1975 | Lynn et al. | 200/5 R X |
| 3,886,012 | 5/1975 | Slater | 200/5 R X |
| 3,890,480 | 6/1975 | Berling et al. | 200/5 R X |

*Primary Examiner*—James R. Scott
*Attorney, Agent, or Firm*—Sewall P. Bronstein; Donald Brown

[57] ABSTRACT

A keyboard device which includes a frame having a plurality of bores in which there is positioned a core for slideable motion therein, and a keyboard top positioned over the bores and preferably sealing each of the cores within the bores of the frame so that no particles of food or dust can accumulate between the cores and the frame while still permitting the cores to be depressed to cause a contactor means to engage contact means. In the preferred embodiment the cores are loose within the bores and are held therein from the top by said keyboard top. In addition, a mask to simulate the appearance of a frame about the portions of the top is provided. In addition, the preferred embodiment is sealed on the top and bottom to protect the in words from the environment.

7 Claims, 12 Drawing Figures

KEYBOARD SWITCH ASSEMBLY WITH IMPROVED PUSHBUTTON AND ASSOCIATED DOUBLE SNAP ACTING ACTUATOR/CONTACTOR STRUCTURE

BACKGROUND OF THE DISCLOSURE

This invention is directed to a new and improved keyboard assembly which provides tactile feel, is easily assembled, is sealed in such a manner that particles of food, dust or liquids are preventing from accumulating between parts of the frame thereof and the keys of the keyboard and the finger manipulated portions thereof are easily cleaned by wiping a damp cloth or the like over the top thereof.

In the food handling industries such as supermarket meat departments, there has developed the need for a keyboard as part of a price marking unit, calculator or the like that can easily be kept clean. Unfortunately, most of the prior art keyboards utilize conventional keys positioned and extending up from a frame and thus food particles and dirt tend to wedge between the frame and the keys. See examples in U.S. Pat. Nos. 3,721,778, 3,705,276 and 3,780,237.

While there are some flat type keyboard assemblies such as shown in U.S. Pat. No. 3,721,778, this construction also usually includes frames over the flat depressible portions and thus is also difficult to keep clean. Such flat keyboard structures also do not provide the tactile feed provided by this invention.

Some prior art keyboards have been at least partially covered or closed but these keyboards have been of a different construction than the present invention and thus do not provide the type of tactile feel to the user achievable with the device of this invention. Reference may be had to U.S. Pat. Nos. 3,743,797, and 3,699,294 which illustrate covered types of keyboard construction.

More particularly, the present invention is an improvement over the keyboard assembly shown in U.S. Pat. No. 3,860,771 (FIG. 19) and is particularly adapted for use in instances where cleanliness of the operable (finger touched) parts of the keyboard is mandatory.

The construction of the preferred form of the present invention also departs from U.S. Pat. No. 3,860,771 in that it permits the use of more simply constructed frames and buttons or cores, and the cores are held within the bores of the frame by the keyboard top sealed to the top of the frame.

In addition, the keyboard of this invention which discloses a rigid core under a top provides improved key click acoustical feedback so that the user can more readily ciscern by sound as well as feel the fact that the key has been depressed.

BRIEF DESCRIPTION OF THE DISCLOSURE

The keyboard of this invention in the preferred embodiment includes a frame having a plurality of bores in which there are positioned slideable cores. The cores are preferably sealed and held in the bores from one side by a top (preferably of flexible material, e.g., plastic in sheet form). The top is preferably provided with projections or protrusions (preferably bubble like) which lie over each of the cores, and which when depressed by a finger preferably causes the cores to move downwardly in order to depress contactor means. Upon release of the projections or protrusions, they preferably have enough elasticity to return on their own to their original outwardly extended position.

It is most preferred that a mask be positioned between the frame and the top to simulate, when looking down at the keyboard, the appearance of a frame about numbers, letters or symbols preferably supported by the projections or protrusions as shown. In addition, it is most preferred that a flexible damper or protective cover (e.g., plastic) be provided between the cores and the contactors to prevent destruction of the contactors to prevent destruction of the contacts during continuous use.

It should also be apparent that while the keyboard may find particular utility in cases where cleanliness is a necessity, the present keyboard may also be used in calculators in place of currently used keyboards.

DETAILED DESCRIPTION OF THE DISCLOSURE

Figure 1:
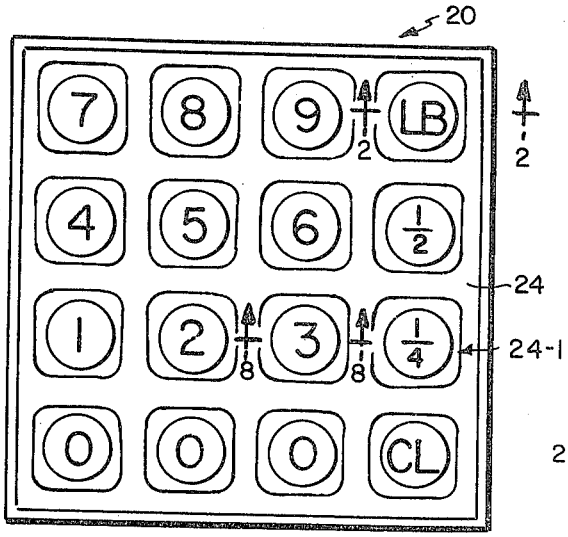
FIG. 1 is a top plan view of the keyboard of the invention.

Reference should now be had to FIGS. 1–11 for a description of a keyboard assembly 20 embodying the invention. The keyboard assembly 20 includes a frame 21 of a plastic, e.g., polysterene, or polypropylene. The frame 21 is open at the bottom and has a plurality of bores 22, preferably cylindrical in shape, in which there is positioned a button or core 23.

The bore may have no stop means to prevent the core from falling out of the frame 21 from either the top or bottom of the bore 22.

Figure 3:
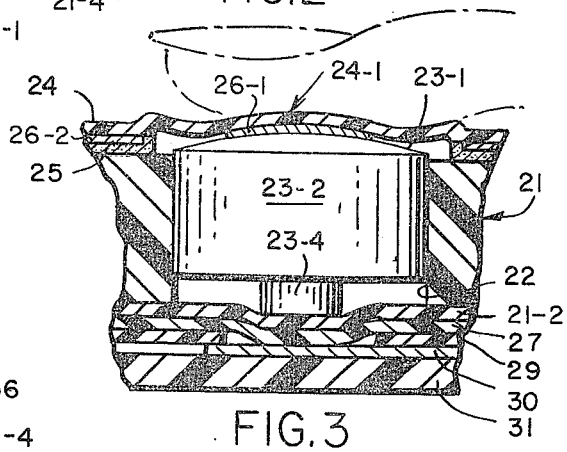
FIG. 3 is a view similar to FIG. 2 illustrating operation of a key of the keyboard.
Figure 4:
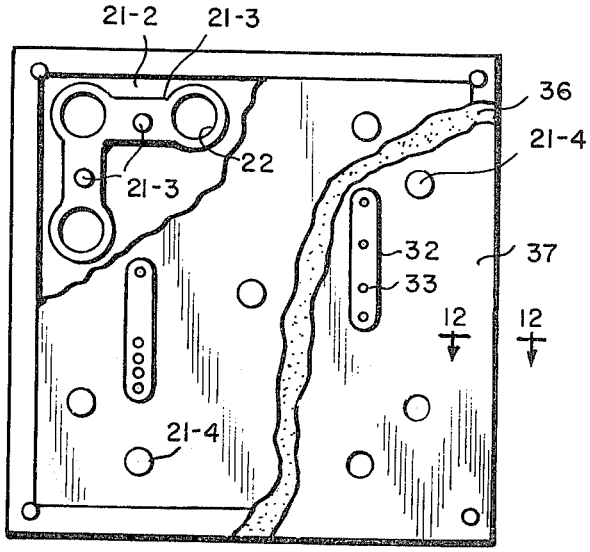
FIG. 4 is a bottom plan view with parts cut away to show a portion of the underside of the frame.
Figure 5:
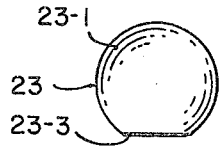
FIGS. 5, 6 and 7 are top, side and bottom views of the core or button of the keyboard.
Figure 6:
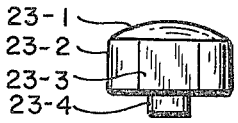
Figure 7:
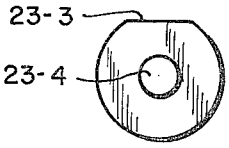
Figure 12:
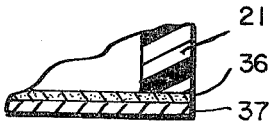
FIG. 12 is a sectional view of the bottom sealing means taken along line 12—12 in FIG. 4.
Figure 8:
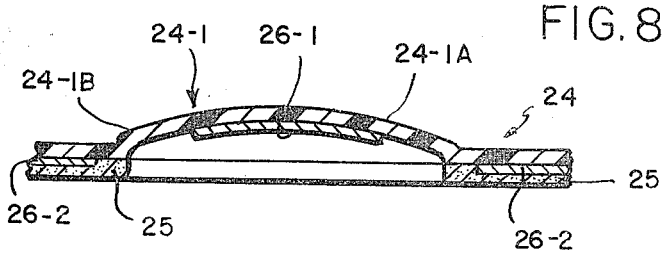
FIG. 8 is a partial sectional view taken along line 8—8 in FIG. 1 illustrating the top, mask and indicia supported by the top.
Figure 9:
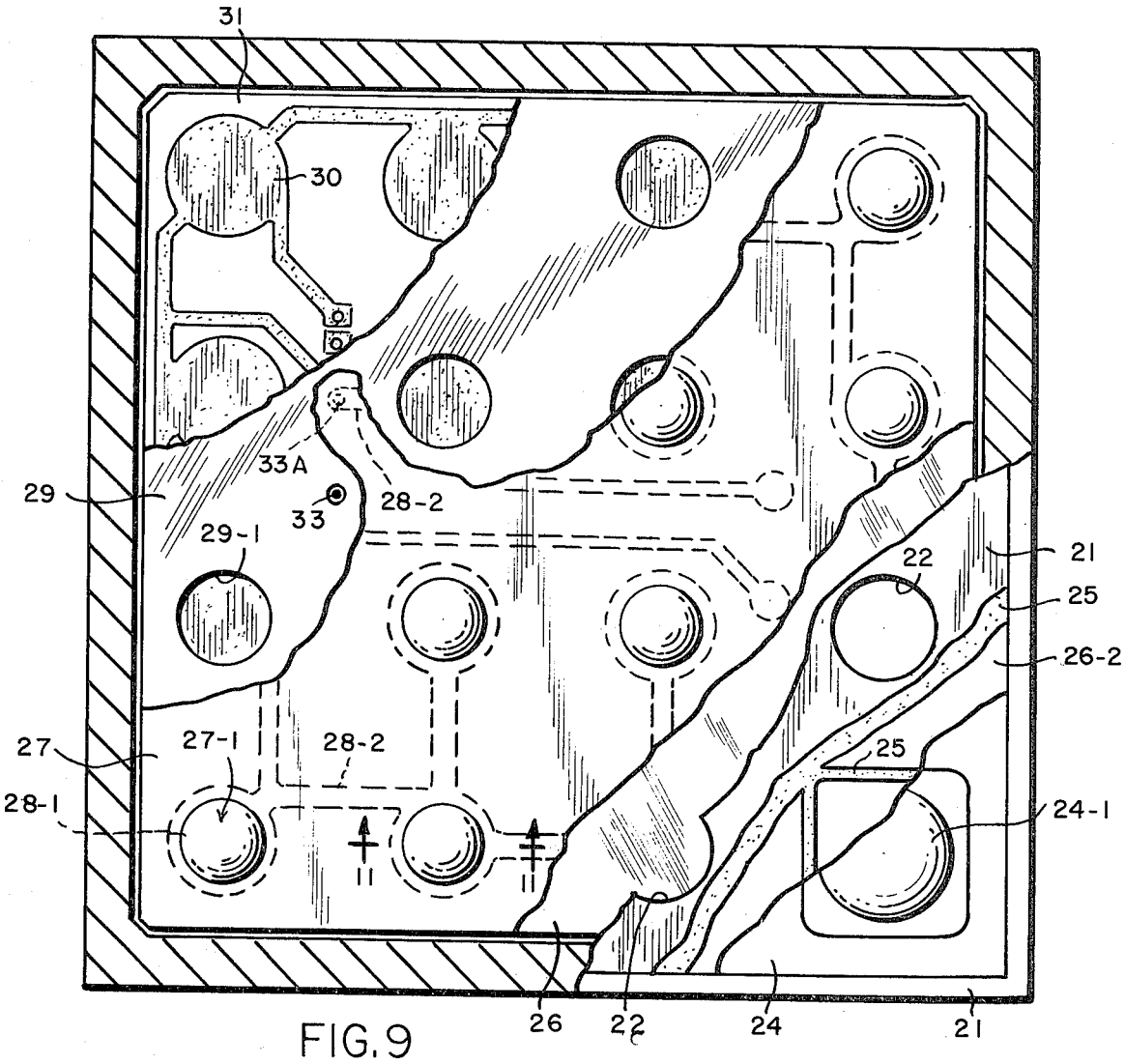
FIG. 9 is a cutaway starting from the top of the keyboard according to the invention.
Figure 10:
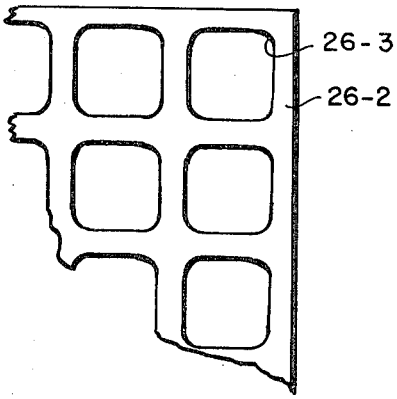
FIG. 10 illustrates a portion of the mask of the invention.
Figure 11:
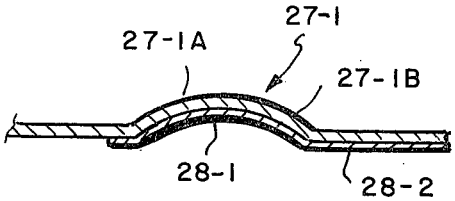
FIG. 11 is a sectional view of the contactor means of the invention, taken along line 11—11 in FIG. 9.

The core includes a cap (preferably a portion of a sphere), a central cylindrical portion 23-2 preferably having a flat side portion which acts to permit entrapped air to escape around the portion 23-3 as the core 23 moves back and forth in the bore 22 as well as permitting gating during molding thereof. The core 23 also includes a projection or pusher 23-4, preferably cylindrically shaped, for pushing contactor means when depressed as shown in FIG. 3.

On the frame 21 and between raised frame ridges 21-1 there is provided a keyboard top 24. The top is preferably of a flexible plastic sheet material such as polyester, polycarbonate, polypropylene, etc., and may preferably be of a thickness e.g., of about 3 to 5 mils. The top is preferably provided with a plurality of protrusions e.g., bubbles 24-1 which rise above the frame surface and which are positioned over and in register with the bores 22. The top is also preferably of sufficiently resilient material that after depression the bubbles will return on their own accord to the raised position shown in FIG. 2.

Figure 2:
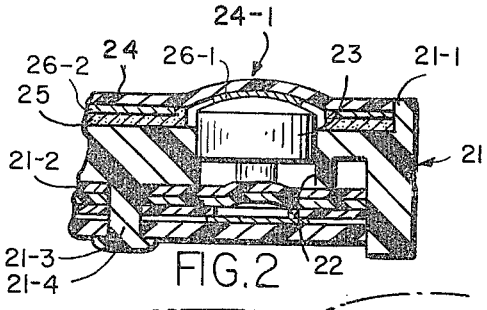
FIG. 2 is a sectional view taken along line 2—2 in FIG. 1.

The bubbles 24-1 are preferably shaped to approximately mate with the contour of the capped spherical portion 23-1 of the core 23 when it is positioned above the top frame surface as shown in FIG. 2.

The bubbles 24-1 may if desired be constructed with a small pedestal 24-1B which is capped with a spherical portion 24-1A to assist in providing tactile feel.

The top 24 is preferably sealed to the frame top surface by adhesive 25 and seals the bores 22. The top 24 preferably supports indicia or symbols e.g., inked or printed 26-1 (letters, numbers, etc.) on the underside of the bubble 24-1, and which may be seen through the bubble from the top.

The top 24 also preferably supports a mask 26-2 (e.g., black) to simulate the appearance of a frame (from above) about the raised projections or bubbles 24 and may be inked on or printed on the underside of the top as is conventional in the art. The mask also may be of paper, plastic, etc. The adhesive layer may also serve as the mask if a dark material adhesive is used. The material of the top 24 is preferably of translucent or transparent material to permit the symbols and mask to be seen from above the top.

Positioned below the frame surface 21-2 there is preferably provided damping means such as a sheet of plastic (as used in this application plastic is meant to include the term rubber), e.g., nitrile rubber, polyethylene, etc. The damping means is used to take out the rattle between the frame, the cores and the contactors as well as to spread out the force applied by the core projection 23-4 on the electrical contactor means shown generally at 27.

The contactor means 27 of this invention is most preferably of the type shown in U.S. Pat. No. 3,860,771 (FIGS. 17 and 18). The entire contents of U.S. Pat. No. 3,860,771 are incorporated herein by reference thereto.

The contactor means as shown in FIGS. 17 and 18 of U.S. Pat. No. 3,860,771 comprises a sheet of plastic insulator material (e.g., Mylar or the other materials shown in U.S. Pat. No. 3,860,771) having a plurality of snappable protrusions 27-1 which supports and has adhered thereto on the underside thereof a flexible electrically conduct plastic circuit pattern 28-2 (see FIGS. 9 and 11 of this application and U.S. Pat. No. 3,860,771).

The protrusions 27-1 preferably include a pedestal portion 27-1B which is capped with a spherical portion 27-1A as disclosed in the aforementioned U.S. Pat. No. 3,860,771.

It should be understood that the contactor may also comprise any of the other various contactor constructions such as shown in U.S. Pat. No. 3,860,771, e.g., a sheet with protrusions and a resilient sheet therebelow where the resilient sheet is itself electrically conductive (contains electrically conductive particles in a resilient plastic binder) or supports layers of conductive materials such as electrically conductive plastics or inks.

Positioned below the contactor means 27 there is preferably provided a snap through plastic insulator layer 29 having a plurality of openings 29-1 in register with said protrusions 27-1 and with selected portions of a circuit 30 (e.g., printed or screened on) which is supported on a conventional circuit board 31.

Connections are made to the circuit pattern by connector 32 through pins 33. One of the pins 33A is also coupled to the circuit pattern of the contactor means 27 in that it extends through the layer 29 to make contact with pattern portions 28-2 (see FIG. 9).

The assembly is held together as shown in FIG. 2 by frame posts 21-3 which extend through holes in the layers 27, 28, 29 and 31 and are conventionally heated to form the buttons 21-4.

At the bottom of the keyboard frame 21 there is preferably provided sealing means 36 for sealing the bottom of the working parts of the keyboard from the external environment. The sealing means 36 preferably specifically seals or closes off the crack between the frame bottom sides and the board 31 although it may seal the entire bottom while leaving an opening for the pin support 32.

The sealing means 36 preferably comprises a plastic layer 21 which has adhesive on the top surface thereof as well as on the bottom surface thereof.

The bottom is preferably provided with a tacky adhesive so that when the pins 33 are plugged in, the keyboard will be firmly anchored in place.

In distributing the device, a peel-off layer 37, e.g., paper, is preferably provided which is peeled off prior to plugging the keyboard into a device.

As used herein the top 24 and bottom sealing means 36 is preferably of substantially non-porous material to seal out the ambient atmosphere and the word seal or sealing when used with or modifying the top 24 or bottom sealing means 36 should be so interpreted.

It will thus be seen that the present invention provides a compact and sealed keyboard assembly. The depression of the protrusions or bubbles 24-1 and the core 23 against the damper sheet means 27 urges the contactor means downwardly. Tactile feel is provided at least in part by the preferred raised protrusions 27-1 which snaps through the center as shown in FIG. 3 to urge contact between electrically conductive material 28-1 and circuit pattern portions 30. Most preferably a snap through layer 29 having in register openings 29-1 is provided to provide a greater tactile feel as in U.S. Pat. No. 3,860,771.

The bubbles 24-1 preferably are shaped to mate with the contour of at least a portion of the top of the core 23-1 and also preferably extend above the surface 21-4 of the frame.

We claim:

1. In a keyboard assembly including first means for supporting electrically conductive contact means, contactor means positioned over but out of electrical contact with said electrically conductive contact means, a frame for supporting said first means, the improvement of said frame having a plurality of bores, extending from a top surface to a bottom surface thereof, a core positioned in each bore for slideable motion therein, each core having a top surface and a bottom surface a keyboard top of flexible and resilient substantially non-porous material positioned over at least portions of said frame top and sealing said bores at the top surface of the frame, a sheet of flexible and resilient insulator material positioned between the bottom of said cores and said said contactor means, said sheet of insulator material having a plurality of raised bubbles, each bubble having at least a snappable curved portion and each bubble extending into a different one of said bores and being surrounded by said bore, each of said bubbles maintaining a portion of each of said cores top surface at least when at rest above the top surface of said frame to which said bores extend and said keyboard top portions sealing each of said bores comprising a raised bubble having a snappable curved surface extending above said bore and extending outwardly beyond the inner wall means defining each of the bores, said keyboard top snappable curved surface over each bore being depressible to urge said respective core bottom surface to force said respective snappable curved surface extending into the bottom of said bore to urge said contact means against said contactor means, both said snappable curved surfaces snapping upon sufficient depression of the respective snappable surface of the keyboard top to cause said contact means to engage said contactor means whereby a double snap action effect is provided.

2. In a keyboard assembly according to claim 1 in which said cores each have a curved top surface for mating with the snappable surface of said bubbles.

3. In a keyboard assembly according to claim 2 in which said keyboard top prevents said cores from sliding completely out of the top of said bores.

4. The assembly according to claim 1 including damper means positioned between the core and contactor means.

5. In a keyboard according to claim 1 in which said top supports a mask outlining a keyboard frame and in which said top projections support at least one symbol.

6. In a keyboard according to claim 1 in which said cores are each provided with a cutaway portion to permit air to pass thereabout.

7. In the keyboard assembly of claim 1 in which the bubbles of the keyboard top and the insulator layer each comprise a pedestal capped with said curved surface about which said curved surface is adapted to snap.

* * * * *

UNITED STATES PATENT AND TRADEMARK OFFICE

CERTIFICATE OF CORRECTION

PATENT NO. : 3,978,297

DATED : AUGUST 3, 1976

INVENTOR(S) : WILLIAM J. LYNN and RICHARD E. SEEGER, JR.

It is certified that error appears in the above-identified patent and that said Letters Patent are hereby corrected as shown below:

CLAIM 1, line 15, cancel the second "said" after "said cores and said".

CLAIM 4, line 1, cancel "1" and insert - 3 -.

Signed and Sealed this

First Day of February 1977

[SEAL]

*Attest:*

RUTH C. MASON
*Attesting Officer*

C. MARSHALL DANN
*Commissioner of Patents and Trademarks*